US009314841B2

(12) United States Patent
Steiner et al.

(10) Patent No.: US 9,314,841 B2
(45) Date of Patent: Apr. 19, 2016

(54) PRESSING DEVICE FOR A CASTING PIPE AT THE SPOUT OF A METALLURGICAL CONTAINER

(75) Inventors: Benno Steiner, Nebikon (CH); Jean-Daniel Cousin, Luzern (CH); Werner Keller, Steinhausen (CH)

(73) Assignees: Stopinc Aktiengesellschaft, Hunenberg (CH); Refractory Intellectual Property GMBH & Co.KG, Vienna (AT)

( * ) Notice: Subject to any disclaimer, the term of this patent is extended or adjusted under 35 U.S.C. 154(b) by 391 days.

(21) Appl. No.: 13/380,635

(22) PCT Filed: Jun. 30, 2010

(86) PCT No.: PCT/EP2010/003855

§ 371 (c)(1),
(2), (4) Date: Feb. 7, 2012

(87) PCT Pub. No.: WO2011/000517

PCT Pub. Date: Jan. 6, 2011

(65) Prior Publication Data

US 2012/0119486 A1 May 17, 2012

(30) Foreign Application Priority Data

Jul. 1, 2009 (EP) ..... 09008614

(51) Int. Cl.
*B22D 41/00* (2006.01)
*B22D 41/56* (2006.01)

(52) U.S. Cl.
CPC ..... *B22D 41/56* (2013.01)

(58) Field of Classification Search
CPC ..... B22D 41/56; B22D 41/50
USPC ..... 222/591, 600, 606, 607; 164/435, 437, 164/335, 306, 119, 308
See application file for complete search history.

(56) References Cited

U.S. PATENT DOCUMENTS 4,526,304 A * 7/1985 Nishimura ..... 222/607
5,390,902 A * 2/1995 Szadkowski ..... 266/217
5,614,121 A 3/1997 Terao et al.
6,082,599 A 7/2000 Richard (Continued)

FOREIGN PATENT DOCUMENTS

CN 2553928 Y 6/2003
CN 2576379 Y 10/2003

(Continued)

OTHER PUBLICATIONS

Abstract of RU 2092281.

(Continued)

*Primary Examiner* — Scott Kastler
*Assistant Examiner* — Michael Aboagye
(74) *Attorney, Agent, or Firm* — Brian Roffe

(57) ABSTRACT

Pressing device for a casting pipe at the spout of a metallurgical container, wherein the pressing device is provided with spring-loaded pressing elements that can be pressed against guide surfaces of a casting pipe. The casting pipe includes a tubular part and an upper plate. The guide surfaces are arranged on the underside of the plate on both sides of the tubular part and are directed downward at an angle. They form a plate cross-section that is tapered downward. The pressing elements are each provided with a head that is convexly curved in the adjustment direction of the casting pipe and can be pressed against a guide surface of the casting pipe, which is curved in the longitudinal direction of the pressing element or in the adjustment direction. Compressive forces exerted by the pressing pins are optimally transmitted, more toward the casting pipe opening and therefore acting more evenly.

20 Claims, 4 Drawing Sheets

(56) References Cited

U.S. PATENT DOCUMENTS

| | | | | |
|---|---|---|---|---|
| 6,216,766 | B1 * | 4/2001 | Benni et al. | 164/306 |
| 6,533,147 | B1 | 3/2003 | Boisdequin | |
| 6,568,571 | B2 * | 5/2003 | Ando et al. | 222/606 |
| 6,772,922 | B2 * | 8/2004 | Renard et al. | 222/600 |
| 8,127,972 | B2 | 3/2012 | Hanse et al. | |
| 2003/0029892 | A1 | 2/2003 | Kawano et al. | |
| 2003/0102611 | A1 | 6/2003 | Renard et al. | |
| 2006/0049555 | A1 | 3/2006 | Hanse et al. | |
| 2014/0326761 | A1 | 11/2014 | McKillen et al. | |

FOREIGN PATENT DOCUMENTS

| | | | | | |
|---|---|---|---|---|---|
| CN | 101288903 | A | | 10/2008 | |
| CN | 101406954 | A | | 4/2009 | |
| EP | 1590114 | | * | 3/2006 | B22D 41/50 |
| EP | 1590114 | B1 | | 3/2006 | |
| JP | 2002011566 | A | | 1/2002 | |
| RU | 2092281 | C1 | | 10/1997 | |

OTHER PUBLICATIONS

Abstract of JP2002011566.

Abstract of CN 2576379.

Abstract of CN 2553928.

Abstract of CN 101288903.

Abstract of CN 101406954.

* cited by examiner

PRESSING DEVICE FOR A CASTING PIPE AT THE SPOUT OF A METALLURGICAL CONTAINER

FIELD OF THE INVENTION

The invention relates to a casting pipe changing device for fixing an interchangeable casting pipe, adjustable laterally to the direction of casting for the purpose of changing, in a casting position at the spout of a metallurgical container. A casting pipe changing device at the spout of a metallurgical container typically comprises spring-loaded pressing elements that can be pressed onto guide surfaces of the casting pipe that has a tubular part and an upper plate, and the guide surfaces on the lower side of the plate are arranged to both sides of the tubular part and directed downwardly at an angle and forming a downwardly tapering plate cross-section.

BACKGROUND OF THE INVENTION

Publication EP-B-1 590 114 discloses a casting pipe that comprises a lower tubular part coaxial to the casting opening axis and an upper plate. There are arranged on the lower side of the plate to both sides of the tubular part level guide surfaces which are directed downwardly at an angle in the casting direction and form a downwardly tapering plate cross-section. The interchangeable casting pipe is fixed in a casting position by means of a casting pipe changing device acting on the guide surfaces and which comprises at least one respective spring-loaded pressing element that can be pressed onto a respective guide surface of the casting pipe.

OBJECTS AND SUMMARY OF THE INVENTION

The object forming the basis of the present invention is to provide a casting pipe changing device of the type specified at the start which, by interacting with particularly advantageously configured guide surfaces of the casting pipe enables optimal compressive force transmission.

This object is achieved according to the invention by a casting pipe changing device in which the pressing elements are respectively provided with a head curved in stages or convexly or similarly, in an adjustment direction of the casting pipe and can be pressed onto a guide surface of the casting pipe that is itself curved in the longitudinal direction or in the adjustment direction.

Further preferred embodiments of the casting pipe changing device according to the invention form the subject matter of the dependent claims.

In the casting pipe changing device according to the invention the respective pressing element is pressed onto a guide surface of the casting pipe which is curved in its longitudinal direction or in the adjustment direction with a head which is curved in stages or convexly or similarly in the adjustment direction of the casting pipe, by means of which the compressive forces exerted by the pressing pins are transmitted more towards the casting pipe opening, and so more evenly. In this way, the risk of cracks occurring in the fire-resistant material, in particular at the cross-over from the plate to the tubular part, is substantially reduced. Moreover, better centering of the casting pipe in the casting position is achieved.

BRIEF DESCRIPTION OF THE DRAWINGS

In the following the invention is described in more detail using the drawings. These show as follows.

DETAILED DESCRIPTION OF THE INVENTION

Figure 1:
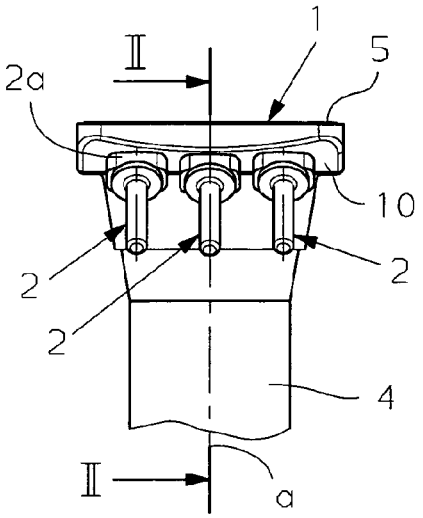
FIG. 1 is a side view of a first exemplary embodiment of a casting pipe with three pressing pins of a pressing device according to the invention.
Figure 2:
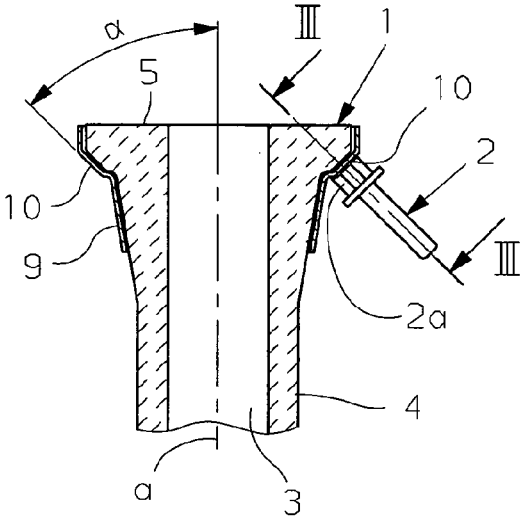
FIG. 2 is a section according to line II-II in FIG. 1.
Figure 3:
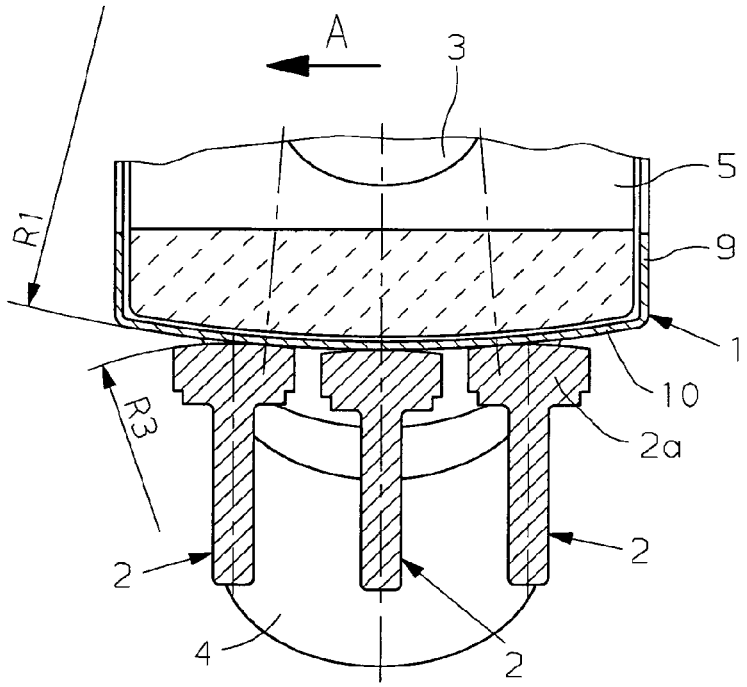
FIG. 3 is a section according to line III-Ill in FIG. 2 in an enlarged scale.

FIGS. 1 to 3 show an interchangeable casting pipe 1 that can be fixed in a casting position at the spout of a metallurgical container by means of a casting pipe changing device. The container itself is not shown in the drawing, and only three pressing pins 2 of the casting pipe changing device can be seen. The spring-loaded pressing pins 2 act on the casting pipe 1 and in a casting position press it either directly against a fire-resistant casing of the container or against a closure plate of a slide closure attached to the container.

The casting pipe 1 has a casting opening 3 and comprises a lower tubular part 4 coaxial to the casting opening axis a and an upper plate 5. The plate 5 has on its lower side two guide surfaces 10 disposed to both sides of the tubular part 4 and which are directed downwardly at an angle in the casting direction and form a downwardly tapering plate cross-section. The angle $\alpha$ enclosed by the guide surfaces 10 with the casting opening axis a can be 20° to 80°, preferably 45°, as shown. By means of the guide surfaces 10 the casting pipe 1 can be adjusted laterally to the casting direction in direction A according to FIG. 3 for the purpose of changing, and a new casting pipe 1 can be brought into the casting position once again.

The aforementioned, spring-loaded pressing pins 2 also act on the guide surfaces 10 (in FIG. 2 one can only see the pressing pin 2 acting on the one guide surface 10; pressing pins 2 are needless to say also assigned to the other guide surface 10).

In their longitudinal direction or in the adjustment direction A of the casting pipe 1 the two guide surfaces 10 of the plate 5 are curved in stages or convexly or in a similar manner, such as for example in an oval, a polygon, approximately round etc. Advantageously they are convexly curved in relation to a centre plane of the plate 5 extending in direction A and comprising the casting opening axis a, the radius of curvature R1 (FIG. 3) being greater than the maximum distance between the respective guide surface 10 and the centre plane of the plate 5 comprising the casting opening axis a.

According to the invention the pressing pins 2 are respectively pressed resiliently against the guide surfaces 10 with a head 2*a* which is convexly curved in the adjustment direction A of the casting pipe 1 and has a radius of curvature R3 (FIG.

3). The pressing pins 2 are in line contact with the guide surfaces 10. The compressive forces exerted onto the plate 5 by pressing pins 2 arranged parallel to one another do not extend in parallel, but are distributed so as to act more into the centre, and so more evenly. In this way the risk of cracks occurring in the fire-resistant material, in particular at the cross-over from the plate 5 to the tubular part 4 is substantially reduced (both the tubular part 4 and the plate 5 are made of a fire-resistant material surrounded by a sheet-metal jacket 9, at least in the plate region).

In the exemplary embodiment shown three pressing pins 2 respectively act on the respective guide surface 10. One could choose a different number of pressing pins 2. When using a number of pressing pins 2 the head height and/or the spring lift of the individual pressing pins 2 arranged next to one another is advantageously matched to the curvature of the respective guide surface 10, and so the bracing force is optimised.

In the embodiment of the casting pipe 1 shown in FIGS. 1 to 3 the guide surfaces 10 directed downwardly at an angle and which are curved in their longitudinal direction or in the adjustment direction A of the casting pipe 1 extend in a straight line viewed in the vertical section, as can be seen in particular from FIG. 2.

Figure 4:
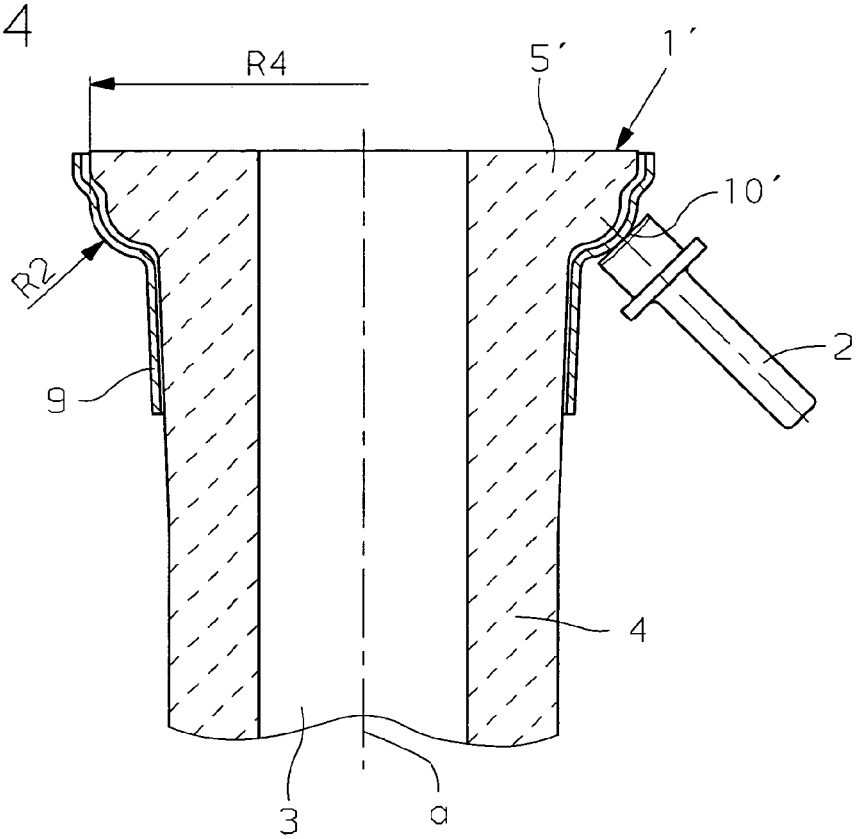
FIG. 4 is a second exemplary embodiment of a casting pipe in an illustration corresponding to FIG. 2.

FIG. 4 shows a casting pipe 1' with a plate 5' the guide surfaces 10' of which in turn have a radius of curvature R4 in their longitudinal direction or in the adjustment direction A of the casting pipe 1, but are additionally also convex in form in the vertical cross-section, i.e. have a curvature to the outside with a radius R2. The radius of curvature R4 of the guide surfaces 10' in the adjustment direction A is eccentric in relation to the casting opening axis a, similarly to in the embodiment according to FIGS. 1 to 3.

Figure 5:
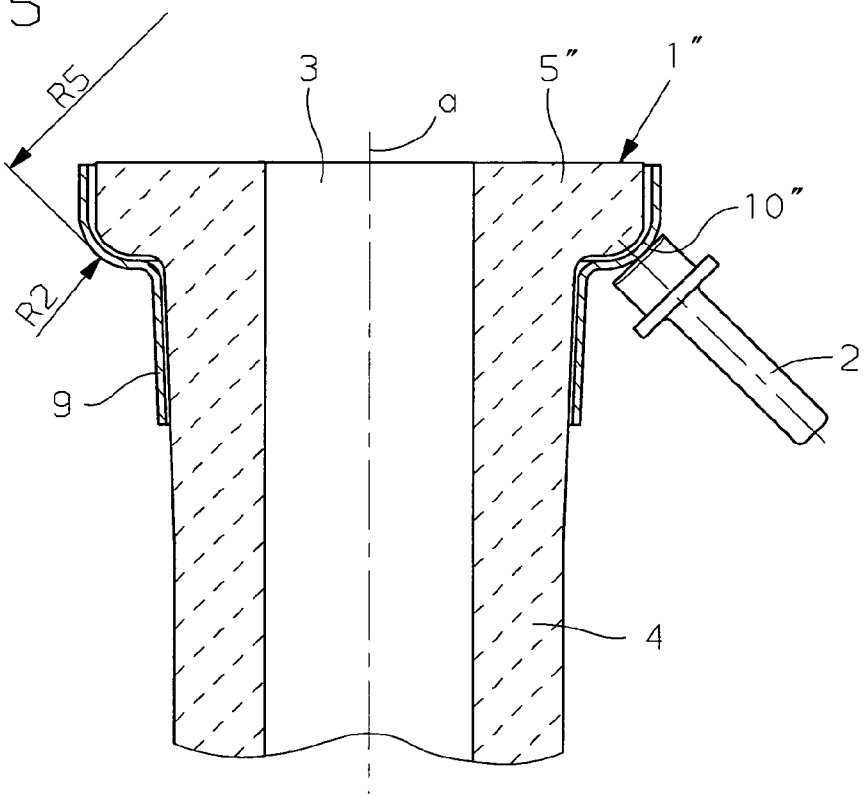
FIG. 5 is a third exemplary embodiment of a casting pipe in an illustration corresponding to FIG. 2.

Also in the version of a casting pipe 1" shown in FIG. 5, the guide surfaces 10" curved in their longitudinal direction or in the adjustment direction A of the casting pipe 1 are additionally also curved to the outside in the vertical cross-section with a radius R5. As regards the radius of curvature R5 of the guide surfaces 10" in the adjustment direction A, this is a so-called inclined circle version in which the curvature having the radius R5 is additionally designed in a positioned inclined, for example, by 45° in relation to the casting opening axis a.

In the versions according to FIG. 4 and FIG. 5 too the pressing pins 2 that are convexly curved in the adjustment direction A of the casting pipe 1' and 1" are in point contact with the corresponding guide surfaces 10' and 10", the compressive forces exerted upon the plate 5' and 5" being distributed more evenly than in known casting pipes with level guide surfaces.

Figure 6:
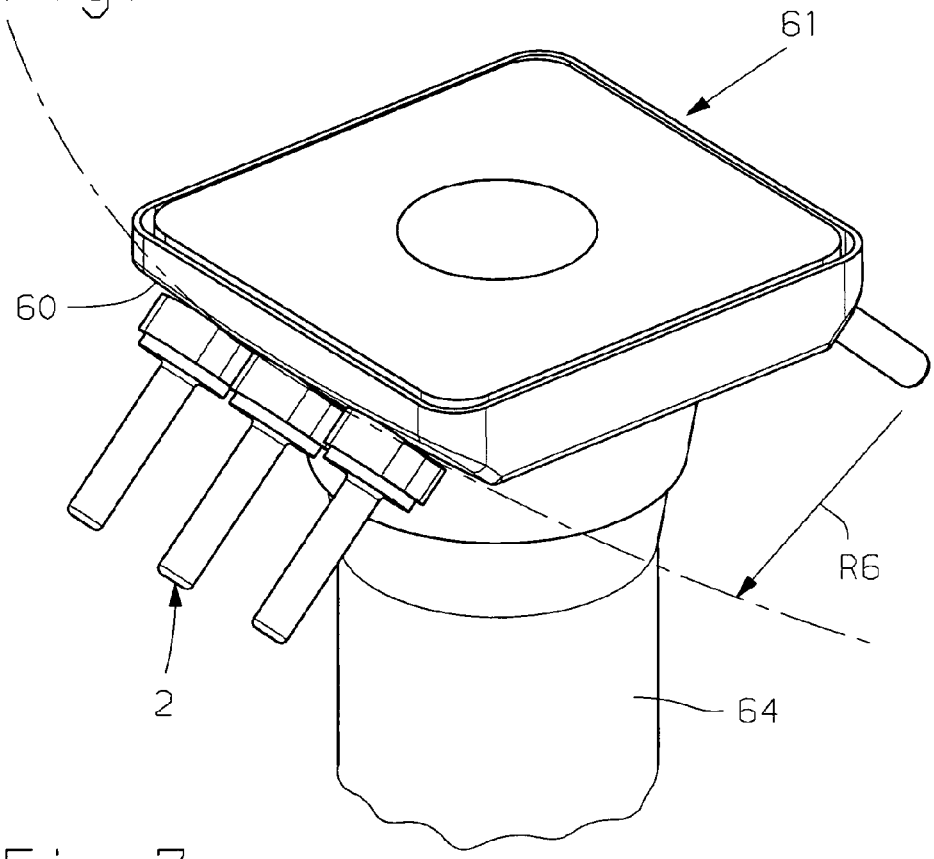
FIG. 6 is a perspective illustration of a further exemplary embodiment of a casting pipe.
Figure 7:
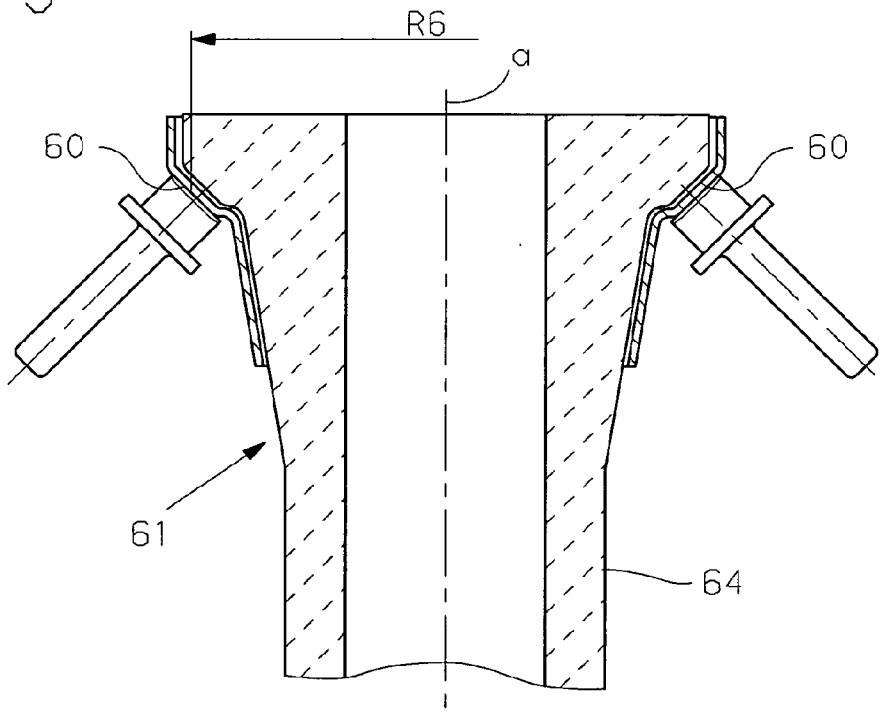
FIG. 7 is a longitudinal section through the casting pipe according to FIG. 6.

FIG. 6 and FIG. 7 show a version of a casting pipe 61 which in itself is configured in the same way as that of FIG. 1 to FIG. 3, and so the differences will now be described in the following. This casting pipe 61 is also provided with these guide surfaces 60 according to the invention which are directed downwardly at an angle in the casting direction and form a downwardly tapering plate cross-section. The main difference with respect to the guide surfaces 10 according to FIG. 1 is that the radius of curvature R6 of the latter is respectively formed in horizontal alignment, i.e. perpendicular to the axis a. This radius of curvature R6 is in turn a multiple greater than the radius of the tubular part 64 of the casting pipe 61.

Figure 8:
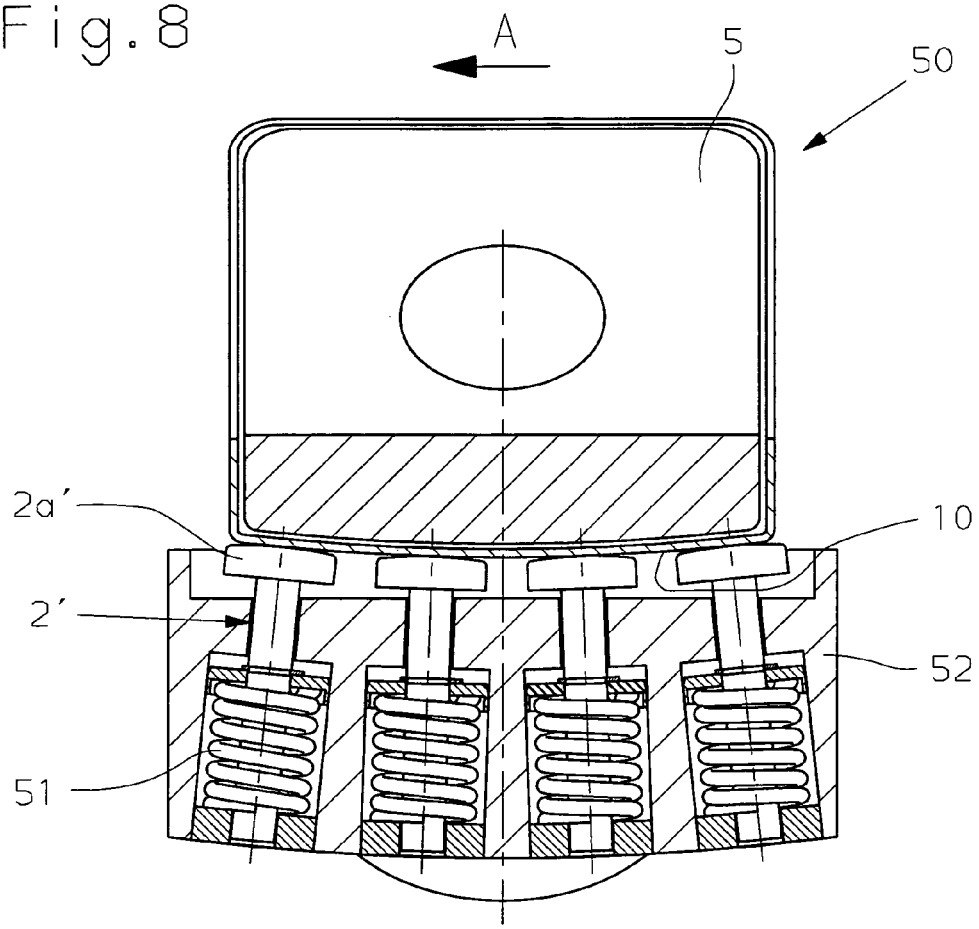
FIG. 8 is an exemplary embodiment of a pressing device according to the invention, with a number and arrangement of the pressing pins that differs from FIGS. 1 to 3.

According to FIG. 8 an exemplary embodiment of a pressing device 50 according to the invention with pressing pins 2' arranged perpendicularly or radially to the guide surface 10 is illustrated. The four pressing pins 2' and the springs 51 acting on the latter, arranged coaxially to the pressing pins 2', are accommodated in a housing 52 from which, needless to say, the heads **2*a*' convexly curved in the adjustment direction A at least partially project. The pressing device 70** has a simple, compact design.

Figure 9:
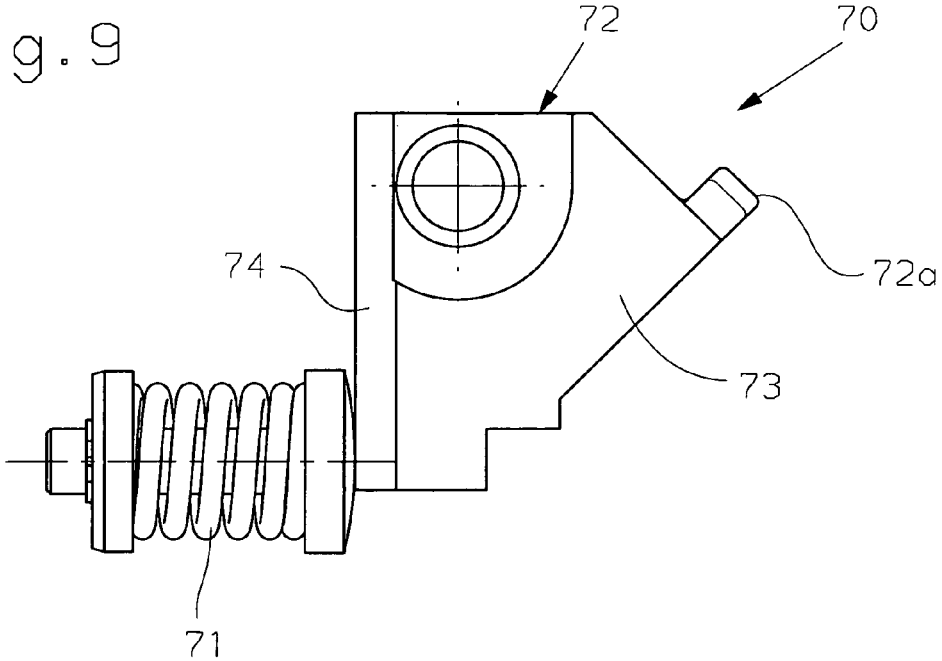
FIG. 9 is a further embodiment of a pressing device according to the invention.

FIG. 9 shows a further embodiment of a casting pipe changing device 70 according to the invention in which the respective pressing element is not configured as a pressing pin, but as a tilting lever 72, one arm 73 of which is provided with the head **72*a* convexly curved in the adjustment direction A of the casting pipe, and another arm 74 is loaded by a spring 71. While pressing of the head is in turn implemented, for example, at an angle of 45° to the vertical casting pipe axis, the respective spring 71 is arranged horizontally. This design is more complicated than that according to FIG. 8 and takes up more space; however, the effect of heat upon the springs 71** is less here.

The invention is sufficiently demonstrated by the exemplary embodiments described. It could, however, also be realised in further versions.

The curvature of the guide surfaces 10; 10'; 10" in their longitudinal direction or in the adjustment direction A of the casting pipe 1; 1'; 1" could theoretically also be realised by dividing the respective guide surface 10; 10'; 10" into level sub-sections which would be at an angle to one another.

In the embodiments described above the radius of curvature formed by the respective guide surface extends either perpendicular or at an angle (e.g. 45°) to the axis a of the casting pipe. In principle, this angle could also be approximately 0°, i.e. the radius of curvature would then be aligned parallel to the axis a. Depending on how this angle is chosen, this also affects the shape of the guide surface in its longitudinal configuration.

Instead of being arranged parallel to one another, the pressing pins could also be arranged perpendicular to the curved guide surfaces or to the sub-sections forming the curvature.

In theory, at least in the casting position, the pressing pins could also be in surface contact instead of in line contact with the guide surfaces.

The invention claimed is:

1. A casting pipe fixing system at a spout of a metallurgical container, comprising a combination of a casting pipe and a pressing system that presses the casting pipe against the spout of the metallurgical container, the casting pipe comprising a tubular part and an upper plate having a lower side, the upper plate having a peripheral area comprising two distinct guide surfaces on two opposing portions of the lower side and two other opposing portions each on a respective side of the upper plate between the guide surfaces such that the tubular part is between the guide surfaces, the guide surfaces being directed downwardly at an angle and forming a downwardly tapering plate cross-section, the guide surfaces being curved in a longitudinal direction of the casting pipe or in an adjustment direction in which the casting pipe is adjusted;

the pressing system including spring-loaded pressing elements configured to be pressed against the casting pipe, the spring-loaded pressing elements being configured to press onto the guide surfaces; and each of said spring-loaded pressing elements including a head configured to be pressed against one of the guide surfaces, each head including an outer surface that is curved in the adjustment direction of the casting pipe and pressed onto the one of the guide surfaces of the casting pipe.

2. The casting pipe fixing system according to claim 1, wherein said pressing elements are respectively configured as a pressing pin provided with a convexly curved head that constitutes the head of said pressing elements, the system further comprising a spring acting on each of said pressing pins and that is arranged coaxially to said pressing pin.

3. The casting pipe fixing system according to claim 2, wherein a number of said pressing pins are arranged next to one another in the adjustment direction of the casting pipe and are configured to be pressed onto the same one of the guide surfaces, said convexly curved head of each of said pressing pins being curved in the adjustment direction.

4. The casting pipe fixing system according to claim 3, wherein said pressing pins that are configured to be pressed onto the same one of the guide surfaces are arranged next to one another in parallel.

5. The casting pipe fixing system according to claim 4, wherein said pressing pins arranged next to one another in parallel are configured such that a height of said heads of said pressing pins arranged next to one another in parallel or spring lift provided by said pressing pins arranged next to one another in parallel match a curvature of the same one of the guide surfaces against which said pressing pins arranged next to one another in parallel are configured to be pressed.

6. The casting pipe fixing system according to claim 3, wherein said pressing pins arranged next to one another in the adjustment direction of the casting pipe are directed perpendicularly to the same one of the guide surfaces against which said pressing pins arranged next to one another in the adjustment direction of the casting pipe are configured to be pressed or to sub-sections forming a curvature of the same one of the guide surfaces against which said pressing pins arranged next to one another in the adjustment direction of the casting pipe are configured to be pressed.

7. The casting pipe fixing system according to claim 1, wherein each of said pressing elements is configured as a tilting lever having an arm including a head convexly curved in the adjustment direction that constitutes the head of said pressing elements and another arm loaded by a spring.

8. The casting pipe fixing system according to claim 1, wherein said outer surface of said head of at least one of said pressing elements is curved in stages.

9. The casting pipe fixing system according to claim 1, wherein said outer surface of said head of at least one of said pressing elements is curved convexly.

10. The casting pipe fixing system according to claim 1, wherein said pressing elements are in line contact with one of the guide surfaces.

11. The casting pipe fixing system according to claim 1, wherein a plurality of said pressing elements are each in line contact with one of the guide surfaces.

12. A casting pipe fixing system at a spout of a metallurgical container, comprising:

a combination of a casting pipe and a pressing system that presses the casting pipe against the spout of the metallurgical container, said casting pipe comprising a tubular part and an upper plate, said upper plate including a lower side, said upper plate having a peripheral area comprising two distinct guide surfaces on two opposing portions of the lower side and two other opposing portions each on a respective side of said upper plate between said guide surfaces such that said tubular part is between said guide surfaces, said guide surfaces being directed downwardly at an angle and forming a downwardly tapering plate cross-section, said guide surfaces being curved in a longitudinal direction of said casting pipe or in an adjustment direction in which said casting pipe is adjusted; and said pressing system comprising spring-loaded pressing elements each including a head configured to be pressed against one of said guide surfaces, each head including an outer surface that is curved in the adjustment direction of said casting pipe and pressed against said one of said guide surfaces of said casting pipe.

13. The casting pipe fixing system according to claim 12, wherein said guide surfaces are curved in the longitudinal direction of the casting pipe.

14. The casting pipe fixing system according to claim 12, wherein said guide surfaces are curved in the adjustment direction in which the casting pipe is adjusted.

15. The casting pipe fixing system according to claim 12, wherein said guide surfaces are directed downwardly at an angle in a direction of casting defined by said casting pipe.

16. The casting pipe fixing system according to claim 12, wherein said guide surfaces are convexly curved in relation to a center plane of said plate extending in the adjustment direction and comprising an axis of a casting opening defined by said casting pipe.

17. The casting pipe fixing system according to claim 12, wherein said upper plate is configured such that a radius of curvature of at least one of said guide surfaces on at least one side of said tubular part is greater than a maximum distance between said guide surface and a center plane of said plate extending in the adjustment direction and comprising an axis of a casting opening defined by said casting pipe.

18. The casting pipe fixing system according to claim 12, wherein said guide surfaces have a radius of curvature relative to an axis of a casting opening defined by said casting pipe.

19. The casting pipe fixing system according to claim 18, wherein said guide surfaces also have an outward curvature in a direction downward away from a plane defined at a top of said plate.

20. The casting pipe fixing system according to claim 12, wherein said outer surface of said head of at least one of said pressing elements is curved convexly.

* * * * *